US006626066B2

(12) United States Patent
Koppe

(10) Patent No.: US 6,626,066 B2
(45) Date of Patent: Sep. 30, 2003

(54) FOLDING SHARPENER TOOL

(76) Inventor: Rudolf Koppe, 1251 Britannia Road, Campbellville, Ontario (CA), L0P 1B0

( * ) Notice: Subject to any disclaimer, the term of this patent is extended or adjusted under 35 U.S.C. 154(b) by 0 days.

(21) Appl. No.: 10/033,588

(22) Filed: Jan. 2, 2002

(65) Prior Publication Data

US 2003/0121368 A1 Jul. 3, 2003

(51) Int. Cl.[7] ..... B24B 3/54
(52) U.S. Cl. ..... 76/87; 76/82; 76/86; 451/555
(58) Field of Search ..... 76/86, 87, 88, 76/89; 30/138, 139; 7/120; 451/523, 524, 540, 555

(56) References Cited

U.S. PATENT DOCUMENTS 3,774,350 A * 11/1973 Bayly ..... 451/540
3,861,246 A * 1/1975 Waller ..... 76/86
4,259,815 A * 4/1981 Kuban ..... 76/86
4,501,068 A * 2/1985 Palson ..... 30/138
4,718,200 A * 1/1988 Miquelot ..... 451/555

* cited by examiner

*Primary Examiner*—Hwei-Siu Payer

(57) ABSTRACT

A foldable hand sharpening tool is disclosed, having an elongate body/handle with a first sharpening member pivotally mounted at one end which folds into the body when not used, and at the other end having a "V" shaped sharpening slot formed by opposing sharpening members with pivotable elongate guide members which pivot into place to retain the blade in alignment in the "V" slot during sharpening and fold into the body when not used.

24 Claims, 3 Drawing Sheets

FOLDING SHARPENER TOOL

This invention relates to a novel foldable hand tool for sharpening the cutting edge of knives and the like, being particularly suitable for convenient pocket carrying.

BACKGROUND OF THE INVENTION

Sharpening hand tools are well known in the prior art, for use in sharpening cutting edges such as the blades of knives and the like cutting instruments.

Pocket sharpening tools, e.g. hand tools which can be comfortably carried in conventional clothing pockets or the like of a user, continue to be desired by the consuming public. Such pocket sharpening tools as may be available, generally comprise a sharpening element such as a small rectilinear composite stone or the like material, that is generally packaged in a pouch or the like for pocket carrying, and which are generally uncomfortable to carry and susceptible to breaking when dropped or subjected to bending forces. The size of the stone is generally small for convenient pocket carrying, which makes the hands-on manipulation of the small stone during the sharpening process generally unsafe for the user and generally reduces the ability to conveniently and accurately sharpen a cutting edge.

It is an object of the present invention to provide a pocket sized sharpening device with protective structure surrounding the sharpening element from breakage.

It is another object of the invention to provide a convenient pocket sized sharpening device comprising a handle for safe hands-on manipulation of the device in association with cutting edges.

It is a further object of the invention to provide a foldable sharpening device, which has convenient means for safely and accurately guiding a cutting edge along a sharpening surface during the sharpening process.

It is a still further object of the invention to provide a portable sharpening device which is convenient and comfortable to carry in conventional pockets of the clothing of a user.

These and other objects of the invention will become apparent in the following recitation of the invention.

SUMMARY OF THE INVENTION

The present invention is a foldable hand sharpening tool, generally comprising an elongate body having a first end containing an elongate sharpening means pivotally mounted along a transverse axis, and an opposite end comprising an opposing element sharpening means, with provision for spaced elongate guide members arranged to guide the cutting edge of a blade in planer orientation to the opposing element sharpening means.

The elongate body functions as both a handle and a receptacle for both sharpening means. The body comprises a hollow(s) adjacent the first end for pivotally folding the elongate sharpening means into for storage, the same and/or different hollow(s) for storage of the elongate guide members when not in use, and functions as a handle for hands-on manipulation when either of the sharpening means are in use.

In accordance with the invention, the elongate body of the tool comprises a first end and opposite end with two oppositely disposed elongate sides extending therebetween, a first axle extending transversely between the sides of the body at about the first end of the body and one or more second axles extending transversely between the sides of the body at about the opposite end.

Pivotally mounted on the first transverse axle at the first end of the body is an elongate sharpening means, said means comprising one or more elongate sharpening members having a surface enabled to abrade and/or sharpen a blade of a knife. By pivot mounting of the elongate sharpening means is meant a sharpening member is independently rotatably mounted to about the first end of the body on the first axle similar to pivot mounting of a folding knife blade, or the axle is rotatably mounted to about the first end of the body, in an arrangement such that the elongate sharpening member can be conveniently rotated (folded) into storage in a hollow between the sides of the body and rotated (unfolded) to extend from the body of the tool for sharpening use. The body functioning as a handle extension for manipulating the first sharpening means during use and as a secure storage receptacle when not in use.

The first sharpening means can comprise one or more sharpening members of any suitable elongate shape which comprise any suitable abrading surface. Thus, a sharpening member may be of any convenient elongate shape such as rectilinear, cone, columnar or the like shape suitably sized to be pivot folded into and/or unfolded out from the sides of the body.

Suitable sharpening surfaces for the sharpening members generally include roughened or ridged surfaces, for example a roughened and/or ridge containing metal surface such as a file surface and the like, a sharpening stone or composite material formed from abrading material or the like, or even a member generally formed from a first material such as a metal or plastic and comprising a grit sharpening material thereon such as diamond or hard stone grit or the like sufficient to abrade material from the cutting edge of a knife.

The opposite second end of the elongate body of the invention comprises an opposing element sharpening means. By opposing element sharpening means is meant a sharpening means comprising opposing mounted sharpener elements between which a blade or the like is drawn for sharpening. Preferably, opposing elements are mounted in an arrangement with guide members positioned to maintain the blade of a knife and the like to be sharpened in guided spacial orientation with the opposing sharpener elements.

The opposing elements of the sharpening means are mounted between the sides of the elongate body proximate the second end thereof, in an offset stacked arrangement wherein sharpening edges, surfaces or the like of opposing adjacent stacked elements define a generally "V" shaped drawing slot through which the blade of a knife can be slidably drawn to abrade the sides of the knife blade proximate the cutting edge to form a sharpened cutting edge. The sharpener elements are arranged so that orientation of the generally "V" shaped drawing slot enables drawing of the blade in a direction generally transverse to the longitudinal axis of the tool, enabling safe positioning of the user's hands along the body of the tool, adjacent the "V" slot, during sharpening.

Sharpener elements of the opposing element sharpening means are generally mounted along adjacent about parallel planes in offset stacked arrangement. In a preferred embodiment, the opposing sharpening elements are arranged about parallel to the longitudinal axis of the elongate body, but it should be understood that such about parallel alignment with the longitudinal axis is not essential.

The sharpener elements may be fixedly, removably or movably mounted to the elongate body. In one embodiment, polygonal sharpener elements having a generally straight sharpening surface along one edge thereof are fixedly offset mounted such that the sharpening edge of each opposing element defines a leg of the generally "V" shaped slot. In another embodiment, each polygonal element comprises two or more sharpening edges and the elements are mounted for convenient repositioning so that a different sharpening edge defines a leg. For example, a quadrangular sharpener element is mounted within a mating quadrangular slot arranged in the elongate body so that an exposed edge of the element defines a leg of the "V" shaped slot. As the exposed edge of the element wears, the element can be removed and reset in the slot with a fresh edge exposed. Similarly, such element may be removable, adjustably or even rotatably mounted by screw or the like means for convenient repositioning of sharpening edges.

In a still further embodiment, opposing elements comprise rotatable disks mounted to axles along the body of the tool proximate the second end a sharpening edge or circumferential surface of the disks forming a curved, generally "V" shaped slot. It should be understood that it is within the contemplation of the invention to use any suitable shape and form of opposing sharpening elements which can be combined to form a generally "V" shaped drawing slot for sharpening a blade.

In a preferred embodiment of the invention the sides of the body of the tool surrounding the common transverse cutting axis are slotted to avoid engaging the blade being drawn through the generally "V" shaped slot during the sharpening process. Two or more opposing sharpening elements can be arranged on the second end of the body, but generally it is preferred to use only two opposing sharpening elements.

Opposing sharpening elements can generally comprise any suitable roughened or ridged surface, for example a roughened and/or ridge containing metal surface such as a file and the like, a sharpening stone or composite material formed from abrading material or the like, or even a metal element comprising a grit sharpening material thereon and the like. In a preferred embodiment, the elements insert into mounting slots of a mounting block and have hardened sharpening edges which are retained by the slot at a defined angle to form the "V" shaped sharpening slot. The elements comprise elongate slots through which screw means adjustably fix their position.

Preferably, elongate guide members are arranged to retain the blade in a defined spacial orientation with the sharpening elements and resist slipping of a blade from the generally "V" shaped slot during sharpening.

The guide members generally comprise an elongate member which pivotally or removably mounts to the elongate body. The guide members are arranged to extend from the body of the tool and comprise a surface which supports the blade in a desirable orientation during sharpening. In one embodiment, a guide member comprises a base pin element which screws into or inserts into a hole or slot integral with the body of the tool and a guide cap which provides the surface which guides the blade. In such embodiment, means are generally provided for storage of the caps when not in use, preferably in a hollow or the like of the body of the tool.

In another embodiment the guide member comprises a base pin element which is pivotally connected to the body and guide caps are integral to or removably connected thereto. In a preferred embodiment, the base pin element of a guide member is pivot mounted at about the opposing sharpening means, so that the guide member can be pivoted into a hollow between the sides when not in use. By pivot mounting of the guide member is meant it is rotatably mounted to the body similar to a folding knife blade, such that the guide member can be conveniently rotated or folded into storage along or between the sides of the body and rotated or folded outwardly to extend from the body as appropriate to guide a blade to be sharpened along the generally "V" shaped slot.

Generally a guide cap can be concentric or eccentric in relationship to the centerline of the base pin element. In one embodiment, the guide cap is removably mounted to the base end and a selection of varying diameter guide caps are provided for selected concentric attachment to the base pin element to enable adjustment of a guide surface in respect to the centerline of the "V" shaped slot. In a further embodiment, a guide cap is eccentrically attached to the base pin element enabling adjustable orientation of a guide surface of the guide pin in respect to the centerline of the "V" shaped sharpening slot.

For a fuller understanding of the device of the present invention, reference should be made to the following detailed description taken in connection with the accompanying drawings.

DETAILED DESCRIPTION OF THE INVENTION

Referring now to FIGS. 1–4, wherein is illustrated an embodiment of the sharpening tool of the invention.

Figure 1:
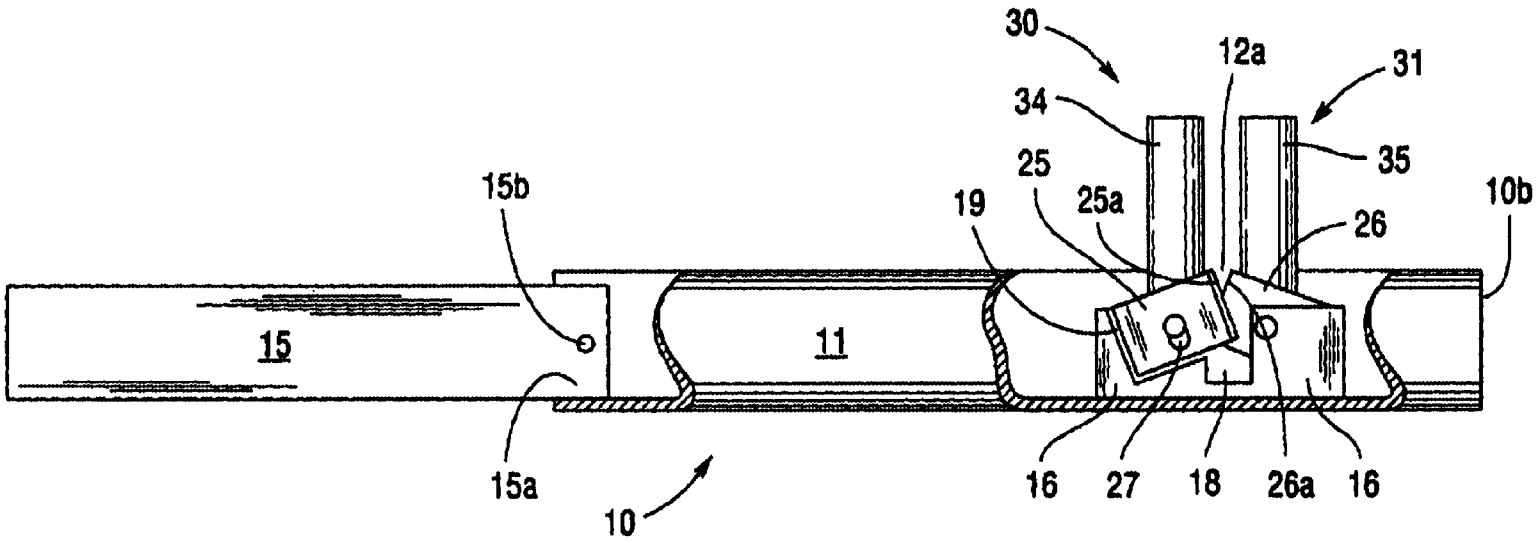
FIG. 1 is a partial sectional, side view of an unfolded sharpening tool of the invention in unfolded position.
Figure 2:
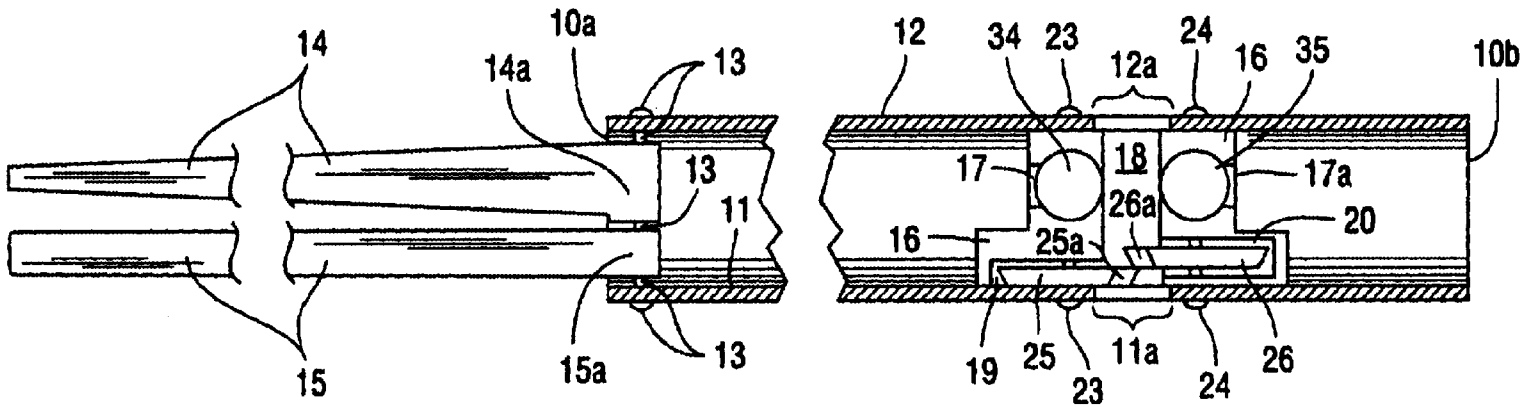
FIG. 2 is an enlarged, fragmented top plan view of the unfolded sharpening tool of FIG. 1.
Figure 3:
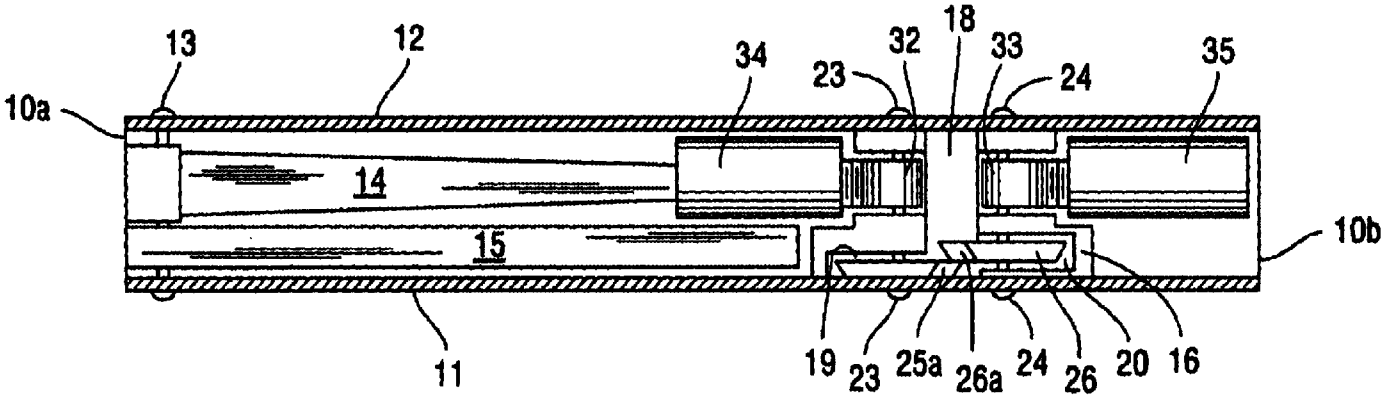
FIG. 3 is an enlarged top plan view of the sharpening tool of FIG. 1 folded up for storage.
Figure 4:
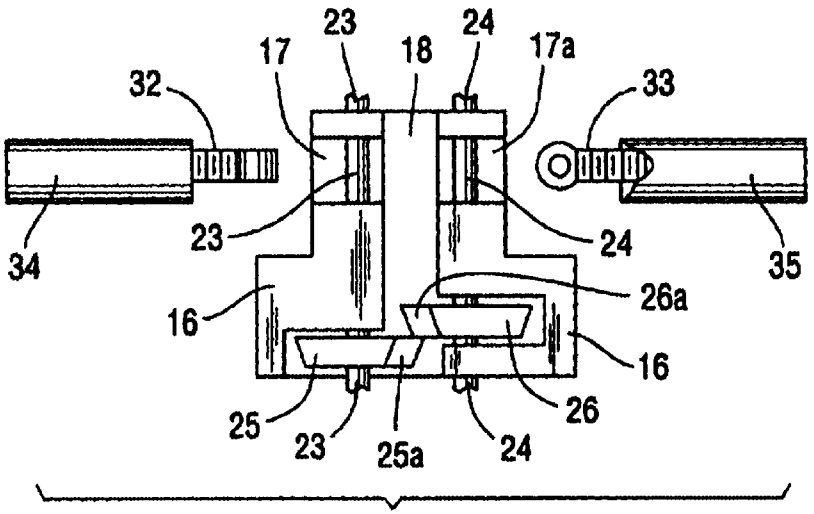
FIG. 4 is partially exploded top plan view of the opposing element sharpening means of FIG. 3.

The elongate body 10 is illustrated as comprising first end 10*a* and opposite end 10*b* with two oppositely disposed elongate sides 11 and 12 extending therebetween. First transverse axle 13 is illustrated as connecting sides 11 and 12 of the body at about first end 10*a* in spaced opposing relationship and providing pivot means for connection of the first sharpening means. Conical sharpening member 14 and rectilinear sharpening member 15 are illustrated as having abrading surfaces and comprising the first sharpening means, and are pivotally connected at ends 14*a* and 15*a* respectively thereof to transverse axle 13 through holes therein (not shown), the arrangement enabling pivoting (folding) of sharpening members from an open position extending from body 10 as illustrated in FIG. 1 to a closed or folded storage position in the first storage hollow extending from first end 10*a* to mounting block 16, arranged between sides 11 and 12 as illustrated in FIG. 3.

The opposing element sharpening means is illustrated as comprising mounting block 16, sized to extend between sides 11 and 12 and arranged to engage the sides in spaced opposing relationship, spaced proximate opposite end 10*b* of the body. The dimensioning and positioning of mounting block 16 spaced proximate opposite end 10*b* comprises the terminus of a first storage hollow extending from the mounting block to first end 10*a* of the body of the tool and the terminus of a second storage hollow extending from the mounting block to the opposite end 10*b* of the body of the tool.

Mounting block 16 comprises guide pivot slots 17 and 17*a*, blade clearance slot 18, opposing sharpening element slots 19 and 20, and spaced transverse axle holes, not shown. Second and third transverse axles 23 and 24 are arranged to extend between sides 11 and 12, through the spaced transverse axle holes, proximate opposite end 10*b* to connect the opposing sides in opposing spaced relationship and provide mounting means for sharpening guides and opposing sharpening elements.

Opposing rectilinear sharpening elements 25 and 26 are mounted in slots 19 and 20, held in place by transverse axles 23 and 24 respectively, and arranged to form a generally "V" shaped sharpening slot between their respective hard metal sharpening edges 25*a* and 26*a*. In the illustrated embodiment, the specific dimensions of the sharpening elements closely mate with the dimensions of slots 19 and 20 to resist pivoting of the axle mounted sharpening elements in the slot and thus resist change in the vertex angle of the "V" shaped sharpening slot formed by the sharpening edges. When the comparative dimensioning of the slots in respect to the mating dimensioning of the sharpening elements is different, the vertex angle of the "V" shaped sharpening slot can change and thus vary the sharpening angle from the cutting edge to the side of the blade. The greater the difference in comparative dimensioning, the greater the vertex change and the greater the variation in sharpening angle. It is generally considered desirable for hand tool cutting efficiency, that the sharpening angle from the cutting edge to the side of the blade be from about 15 degrees to about 25 degrees and most preferably about 20 degrees. Thus, the vertex angle of the "V" shaped slot is preferably from about 30 degrees to about 50 degrees and most preferably about 40 degrees. Beveling the angle of the sharpening edge of the elements increases sharpening efficiency and providing a sharpening edge on each of the polygonal sides allows re-positioning of the elements for extended life. Sharpening element 25 is illustrated as comprising mounting slot 27, to enable adjustable fixed mounting of the element.

Sides 11 and 12 are illustrated as comprising "U" slots at 11*a* and 12*a* respectively, adjacent the ends of blade clearance slot 18 in general alignment with the generally "V" shaped slot formed by opposing sharpening edges 25*a* and 26*a*, to avoid unintentional engaging of a blade being sharpened with the sides.

Guide members 30 and 31 are illustrated as comprising male threaded base pin elements 32 and 33 respectively, with mating female threaded eccentric guide caps 34 and 35 respectively, mounted thereon. Threaded base pin elements 32 and 33 are pivotally mounted to transverse axles 23 and 24 in guide pivot slots 17 and 17*a* respectively of mounting block 16. Eccentric guide caps 34 and 35 comprise off-center holes threaded to mate with threaded pin elements 32 and 33 respectively. The guide members are arranged to be unfolded from storage positions in the first and second storage hollows, into positions spaced opposite each other along blade clearance slot 18. The eccentric mounting of the guide caps enable eccentric adjustment of the guide caps relative to the pin elements so as to micro adjust spacing between the pin elements toward and away from the blade being guided, by rotation of the caps thereon.

Figure 5:
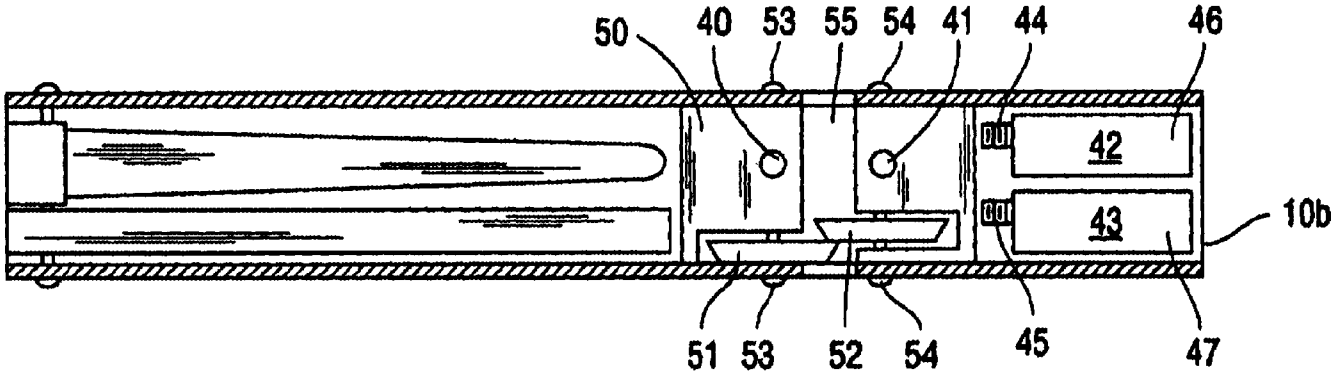
FIG. 5 is a top plan view of a further folded sharpening tool of the invention.

Referring now to FIG. 5 wherein is illustrated a top plan view of a further embodiment of the invention with mounting block 50 comprising threaded holes 40 and 41 for mounting of removable guide members 42 and 43 respectively. In this embodiment removable guide member 42 and 43 comprise male threaded base pin elements 44 and 45 respectively, and mating female threaded eccentric caps 46 and 47 respectively. The base pin elements are arranged to be removable threaded into holes 40 and 41, and the eccentric mounting of eccentric guide caps 46 and 47 arranged to enable micro adjustment of spacing between the elements by rotation of the guide caps. In this embodiment, both guide members are removed from threaded holes 40 and 41 for storage in the second storage hollow extending from the mounting block to the opposite end 10*b* of the body of the tool. In this embodiment, the second hollow comprises retaining means such as gripping means, door means, cover means or the like arranged to retain the guide members in the hollow when not in use.

It should be understood that the micro-adjustable guide members of the foldable tool illustrated in the drawings is a preferred embodiment, and any suitable guide members which can be pivoted and/or removably mounted to guide the blade during the sharpening process can be used with the tool. Thus, a guide member may be rod or the like which pivots into position or is inserted or screwed or the like into a hole or slot positioned to guide the blade in the Generally "V" shaped slot. Similarly, a guide cap may comprise a non-threaded eccentric hole and with the cap being held into eccentric position by alternate means such as a knurled nut or the like arranged to engage a threaded base element extending through the guide cap, arranged to retain the guide cap in a desired eccentric position on the base pin element.

Figure 6:
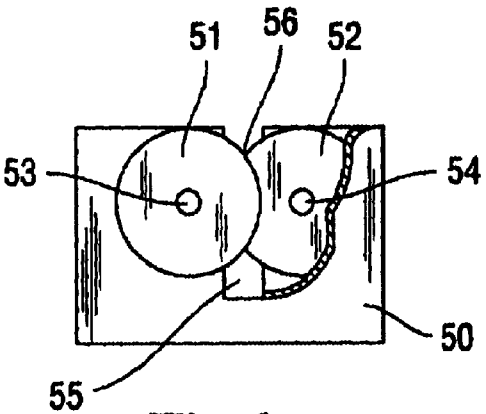
FIG. 6 is a front, fragmented plan view of the opposing element sharpening means of FIG. 5.

FIG. 6 illustrates a front view of the opposing element sharpening means in FIG. 5. Therein, opposing sharpening disks 51 and 52 are rotatably mounted on opposite sides of clearance slot 55 to transverse axles 53 and 54 of mounting block 50, to form a generally "V" shaped sharpening slot 56. In this embodiment the disks are illustrated as comprising a generally flat circumference comprising an abrading sharpening surface.

I claim:

1. A foldable, portable sharpening tool comprising:

an elongate body having two oppositely disposed sides, said body having a first end and opposite second end;

said first end comprising an elongate first sharpening means pivotally mounted along a transverse axis to enable pivoting thereof from a closed position between said two sides of said body to an open position extending from said first end;

wherein said body comprises a second sharpening means arranged proximate said second end, said second sharpening means having generally opposing sharpening elements arranged to form a generally "V" shaped sharpening slot.

2. The sharpening tool of claim 1 wherein said generally opposing sharpening elements are mounted between said oppositely disposed sides of said body.

3. The sharpening tool of claim 2 wherein sharpening surfaces of said generally opposing sharpening elements are arranged to form said generally "V" shaped sharpening slot.

4. The sharpening tool of claim 2 wherein said generally "V" shaped sharpening slot is arranged to enable drawing a blade to be sharpened through said slot in a direction generally transverse to a longitudinal axis of said elongate body.

5. The sharpening tool of claim 4 wherein said sharpening elements are mounted in off-set opposition along axes generally transverse to a longitudinal axis of said elongate body.

6. The sharpening tool of claim 5 wherein said opposing sharpening elements comprise polygonal plates.

7. The sharpening tool of claim 6 wherein said plates comprise an abrading edge.

8. The sharpening tool of claim 5 wherein said opposing sharpening elements comprise circular disks.

9. The sharpening tool of claim 8 wherein said disks comprise a cylindrical abrading surface.

10. The sharpening tool of claim 8 wherein said disks comprise an abrading edge.

11. The sharpening tool of claim 1 wherein said sharpening elements are in off-set opposition.

12. The sharpening tool of claim 1 comprising an elongate guide member arranged to guide a cutting blade in said generally "V" shaped sharpening slot.

13. The sharpening tool of claim 12 wherein said elongate guide member is arranged to pivot from a folded position between about said two sides of said body, to an unfolded position extending from said body proximate said generally "V" shaped sharpening slot.

14. The sharpening tool of claim 12 wherein said guide member is enabled for incremental adjustment toward and away from a cutting blade to be guided in said "V" shaped slot.

15. The sharpening tool of claim 14 wherein said guide member comprises a base pin element and a guide cap, said guide cap being eccentrically mounted to said base pin element and said base pin element being pivotally connected to a transverse axle.

16. The sharpening tool of claim 15 wherein rotation of said guide cap with respect to said base pin element enables incremental adjustment of said guide cap toward and away from said cutting blade.

17. The sharpening tool of claim 12 wherein the vertex angle of said generally "V" shaped sharpening slot is from about 30 degrees to about 50 degrees.

18. The sharpening tool of claim 17 wherein said vertex angle of said generally "V" shaped sharpening slot is about 40 degrees.

19. The sharpening tool of claim 12 wherein said guide member supports said cutting blade in said generally "V" shaped sharpening slot at an angle generally bisecting the vertex of said "V" shaped slot.

20. The sharpening tool of claim 12 wherein said elongate guide member is removably mounted to said body.

21. The sharpening tool of claim 1 wherein said elongate first sharpening means comprises two separately pivotable elongate sharpening members mounted along said transverse axis.

22. The sharpening tool of claim 1 wherein said elongate first sharpening means is selected from conical and rectilinear sharpening stone.

23. The sharpening tool of claim 1 wherein a side of said body is slotted adjacent said generally "V" shaped sharpening slot.

24. A foldable, portable sharpening tool comprising:

an elongate body having two oppositely disposed sides, said body having a first end and opposite second end;

said first end comprising an elongate first sharpening means pivotally mounted along a transverse axis to enable pivoting thereof from a closed position between said two sides of said body to an open position extending from said first end;

a second sharpening means, arranged proximate said second end, said second sharpening means having generally off-set opposing sharpening elements arranged to form a generally "V" shaped sharpening slot; and an elongate guide member, arranged to guide a cutting blade in said generally "V" shaped sharpening slot.

* * * * *